US005683542A

United States Patent [19]

Poole

[11] Patent Number: 5,683,542

[45] Date of Patent: Nov. 4, 1997

[54] ROLL HOLDER WITH RETENTION MEMBER

[75] Inventor: Dan B. Poole, Phoenix, Ariz.

[73] Assignee: Blackhawk Metals, Phoenix, Ariz.

[21] Appl. No.: 468,257

[22] Filed: Jun. 6, 1995

[51] Int. Cl.[6] ..... B32B 31/00

[52] U.S. Cl. ..... 156/494; 156/527; 156/554; 156/577; 156/579; 16/110.5; 81/490; 81/492

[58] Field of Search ..... 156/527, 554, 156/577, 579, 494; 16/110 R, 110.5, 114 R, 115; 81/489, 490, 492

[56] References Cited

U.S. PATENT DOCUMENTS

| | | | |
|---|---|---|---|
| 2,655,963 | 10/1953 | Dell | 81/492 |
| 4,096,021 | 6/1978 | Pool et al. | 156/527 |
| 4,379,019 | 4/1983 | Pool | 156/527 |
| 4,667,891 | 5/1987 | Pool | 242/75.4 |
| 4,783,016 | 11/1988 | Pool | 242/55.2 |
| 4,934,223 | 6/1990 | Wong | 81/490 |
| 4,974,286 | 12/1990 | Stowell et al. | 81/489 X |
| 4,976,175 | 12/1990 | Hung | 81/490 X |
| 5,037,501 | 8/1991 | Lawson | 156/527 |
| 5,099,546 | 3/1992 | Mackal | 16/122 X |
| 5,317,795 | 6/1994 | Bolton et al. | 16/115 X |

*Primary Examiner*—James Sells
*Attorney, Agent, or Firm*—Parsons & Goltry; Robert A. Parsons; Michael W. Goltry

[57] ABSTRACT

A handle is carried upon a frame at a balanced point thereof for supporting the hand held masking in a generally balanced orientation when lifted. The handle includes an open free end accessing a chamber for removably storing selected items. The handle also includes a capping member detachably engageable with the open end for selectively closing the open end, and may include a lanyard attached thereto. A roll of tape or paper is releasably retained upon a roll holder by a flexible retention member, carried by the holder and normally outwardly biased to engage the core of the roll. More specifically, the retention member includes a mandrel having normally extending biased segments which engage the bore of the roll. A pivotally connected tensioning member is biased to urge a free end thereof against the outer surface of the paper roll to check uncoiling of the paper sheet. The free end of the tensioning member includes a lifting portion, accessible by a finger of a hand maintaining a grip upon a handle, for releasing the free end from the outer surface of the roll of paper. A cutting means is also provided having a male/female engagement pair for securing a blade portion to the frame, the male engagement element carried by the blade portion, and the female engagement element carried by the frame.

17 Claims, 10 Drawing Sheets

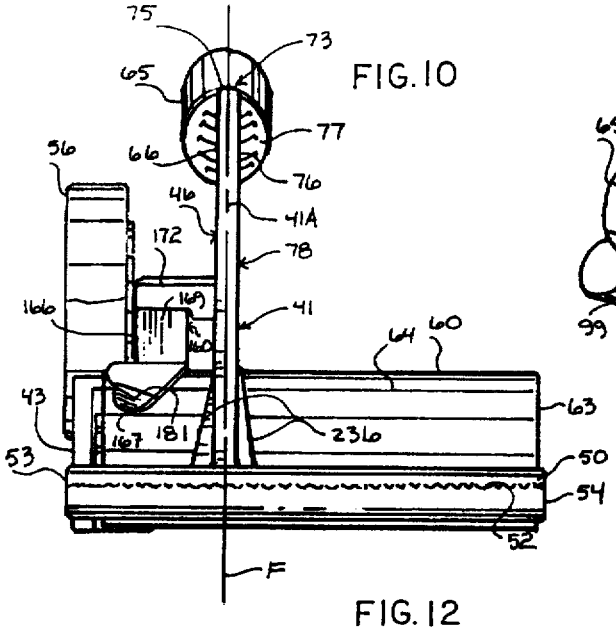
FIG. 10
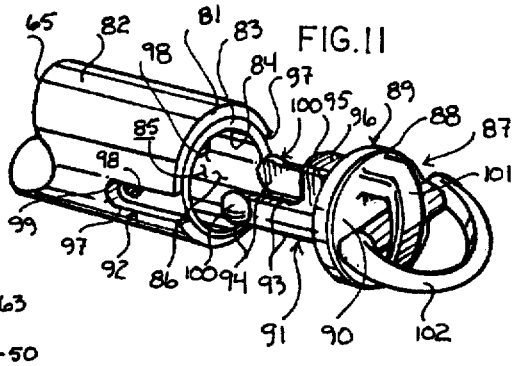
FIG. 11
FIG. 12
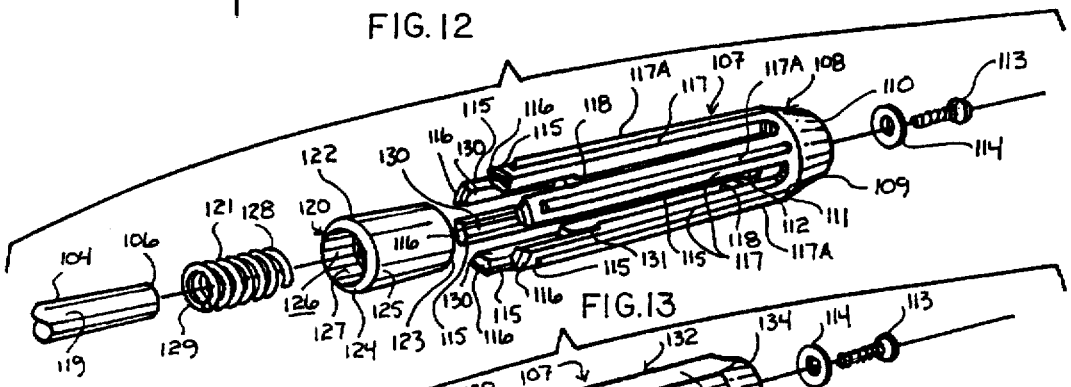
FIG. 13
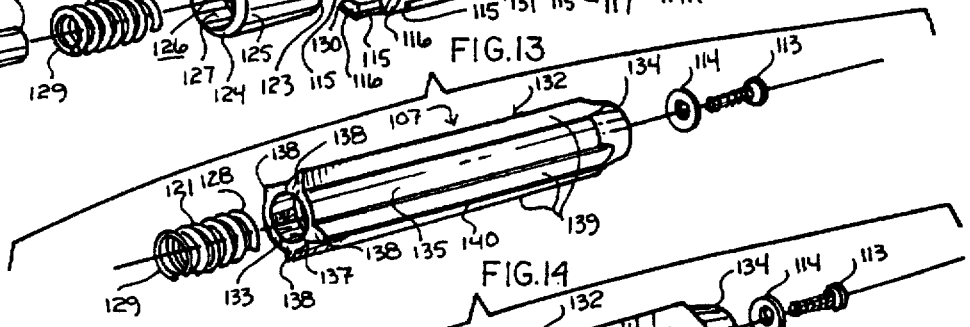
FIG. 14
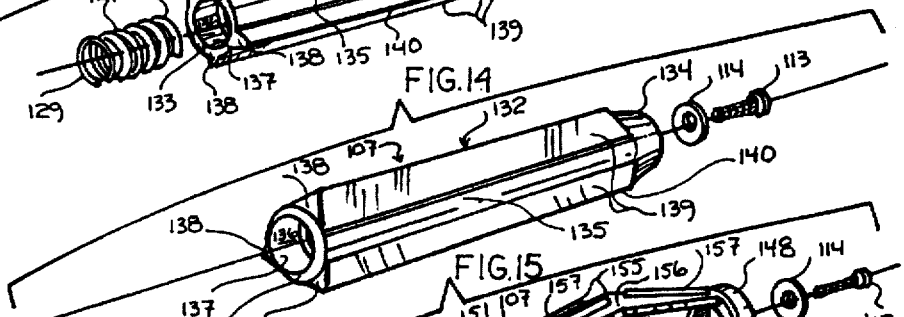
FIG. 15
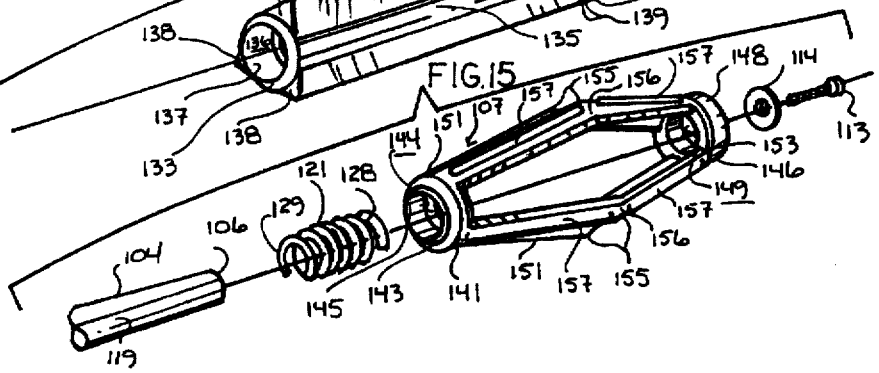

FIG. 16
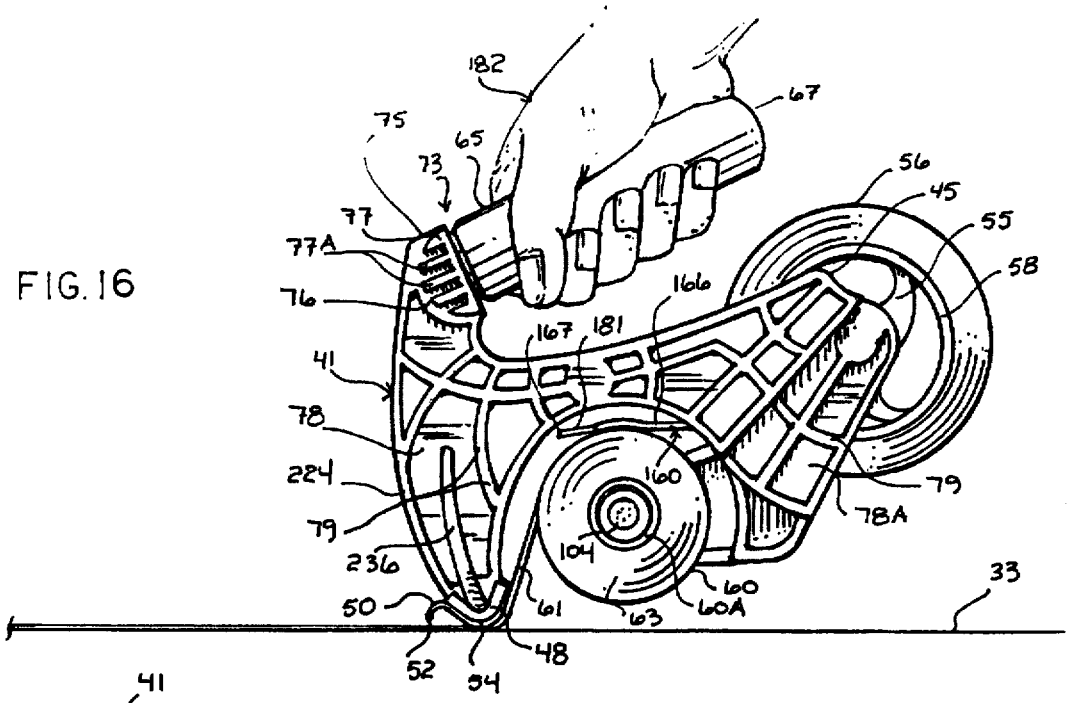
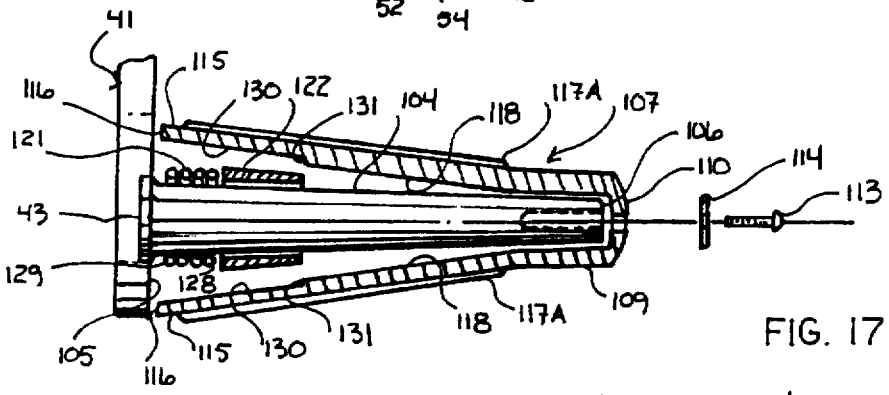
FIG. 17
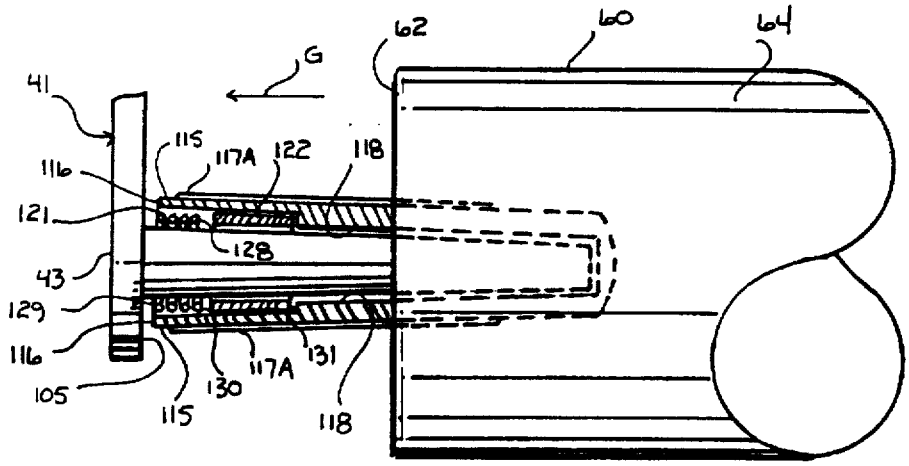
FIG. 18

ROLL HOLDER WITH RETENTION MEMBER

BACKGROUND OF THE INVENTION

1. Field of the Invention

This invention relates to masking machines.

More particularly, the instant invention relates to masking machines such as the hand-held type used for applying tape and paper to a surface preparatory to applying a finish to the surface.

In a further and more specific aspect, the present invention relates to improvements to enhance the utility of masking machines.

2. Prior Art

The prior art is replete with various devices for applying tape and paper to a surface in preparation for painting, trimming and other finishing techniques. In general, such devices, which have achieved broad acceptance by both industrial and non-commercial users alike, are employed for protecting a designated portion of a surface from a finish or treatment applied to an adjacent portion of the surface. Exemplary is the general painting and decorative trimming of vehicle bodies, walls of buildings and other large and small items in connection with vocational and avocational pursuits.

Generally referred to as masking machines, the devices are available in a variety of sizes and configurations especially adapted for various uses. While having similar function, specifically the dispensing of tape and paper, and having commonly analogous components including a holder for a roll of tape, a holder for a roll of paper and a cutting edge for severing the tape and the paper, the various masking machines present exceedingly dissimilar appearances. The apron machine, for example, is usually a large, bulky, floor-supported apparatus. The hand held machine, on the other hand, is a relatively lightweight and compact unit.

Exemplary of prior art masking machines, and herein chosen for purposes of orientation in connection with the instant invention, is the hand held device which includes a handled frame having a rotatably affixed paper roll holder and a rotatably affixed tape roll holder for supporting a roll of coiled paper sheet and a roll of coiled, pressure sensitive tape, respectively. The holders, which have parallel axes of rotation, are oriented such that the tape is dispensed along and overlapping an edge of the paper sheet. As the machine is moved along, the paper and the tape are drawn therefrom and the free portion of the tape is adhesively secured to the surface by the wiping action of the curved portion of a guide bar. When the end of the areas to be masked has been reached, the tape and paper are severed by an elongate cutting edge extending from the frame parallel to the axis of rotation of the holders.

The masking machine, as described above, has proven to satisfactorily achieve the objects for which it was devised. This is attested, in part, by commercial success. Observation, however, has indicated areas of interest and concern not before considered in connection with the instant machine or analogous devices.

Tape and paper, for example, are available in various widths. Users, therefore, frequently exchange the rolls of tape and paper in accordance with the requirements of the immediate task. As a result, the cardboard tube forming the core of the roll becomes enlarged, impairing proper fit of the roll upon the holder. An analogous problem of improper fit, either too loose or too tight, occurs in new rolls as a result of the inherent variance in the size of cores.

Observations of operators utilizing the machine has revealed other phenomena. For example, users frequently carry an additional roll of tape for periodic or continuous taping along the free edge of the paper sheet. Also, it is noted that the paper tension spring which insures even movement of the roll of paper and prevents inadvertent unrolling requires independent manual manipulation as the paper roll is installed upon the paper roll holder.

In view of the foregoing and other observations, experimentation has been conducted for the purpose of improving the referenced masking machine and other similar devices.

Accordingly, it is an object of the instant invention to provide improvements for masking machines.

Another object of the invention is the provision of improvements which will enhance the function of the machine and facilitate convenience of the operator.

Still another object of the invention is to provide improved means for detachably securing the roll of tape and the roll of paper to the respective roll holders.

And another object of this invention is the provision of an improved roll holder which will properly accept rolls of varying size.

Yet another object of the invention is to provide means which will reduce manual manipulation while affixing a roll of paper.

And still another object of the invention is the provision of presenting a conveniently available roll of tape for selective use by the operator.

Yet still another object of the invention is to provide selectively usable means for optional continuous taping along the free edge of the paper sheet.

And a further object of the present invention is the provision of improved paper tensioning means. Still a further object of the invention is to provide means which facilitate the rapid and convenient exchange of rolls upon the roll holders.

Yet still a further object of the invention is the provision of improvements, as above, which are usable upon hand held and other masking machines.

SUMMARY OF THE INVENTION

Briefly, to achieve the desired objects of the instant invention in accordance with a preferred embodiment thereof, first provided are retention means usable in connection with the respective roll holders for holding the roll of tape and the roll of paper sheet. The retention means includes an element extendably and retractably movable relative the holder and normally extendably biased so as to engage the bore of the respective roll. More specifically, the retention means includes a mandrel having normally extending biased segments which engage the bore of the roll.

Next provided are a handle means for improving the balance of the machine during use including an elongate handle having an end carried by the frame at a balanced point thereof. Also included with respect to the elongate handle is a chamber formed within the handle serving as a storage means for removably storing selected items. The elongate handle also includes on open free end accessing the chamber. Additionally, a lanyard may also be attached to the frame at a balanced point for holding the hand held masking machine in a generally balanced orientation during non-use.

Further improvements for the masking machine include a closure means, proximate the open free end of the elongate handle, for closing the open end. The closure means includes a capping member having an end receivable by the chamber, and a means for detachably engaging the free end of the elongate handle with the capping member. The outer end of the capping member may include a lanyard attached thereto.

Next provided are means for checking the uncoiling of the paper sheet including a tensioning member having a fixed end pivotally connected to the frame of the machine, and terminating with a free end. Biasing means carried at the fixed end of the tensioning member, urges the free end toward the holder for bearing against the outer surface of the roll of paper. Also carried at the free end is a lifting portion, accessible by a finger of a hand while the hand is gripping the elongate handle, for releasing the free end from the outer surface of the roll of paper.

Yet another improvement includes a cutting means, carried by the frame, for severing the paper and the tape from the hand held masking machine. In a further aspect, the cutting means includes a male/female engagement pair for securing a blade portion to the frame, the male engagement element carried, by the blade portion, and the female engagement element carried by the frame.

BRIEF DESCRIPTION OF THE DRAWINGS

The foregoing, and further and more specific objects of the instant invention will become readily apparent to those skilled in the art from the following detailed description of a preferred embodiment thereof taken in conjunction with the drawings, in which:

FIG. 10 is a front elevational view of the hand held masking machine of FIG. 1;

FIG. 11 is an enlarged exploded fragmentary perspective view of an embodiment of the handle portion of the instant invention incorporating improvements constructed in accordance with the teachings of the instant invention;

FIG. 12 is an enlarged exploded perspective view of the improved paper roll holder seen in FIG. 4;

FIG. 13 is an enlarged exploded perspective view of an alternate embodiment of the improved paper roll holder very similar to the view of FIG. 12;

FIG. 14 is an enlarged exploded perspective view of yet another alternate embodiment of the improved paper roll holder very similar to FIG. 13;

FIG. 15 is an enlarged exploded perspective view of still another alternate embodiment of the improved paper roll holder very similar to FIG. 12;

FIG. 16 is an inner side elevational view of the hand held masking machine very similar to that seen in FIG. 1, and further illustrating the masking machine as it might appear in use;

FIG. 17 is an enlarged sectional view of the embodiment of the improved paper roll holder as seen in FIG. 12;

FIG. 18 is an enlarged sectional view of the embodiment of the improved paper roll holder as seen in FIG. 17, and further illustrating a roll of paper being installed thereon;

DETAILED DESCRIPTION OF THE PREFERRED EMBODIMENT

Figure 1:
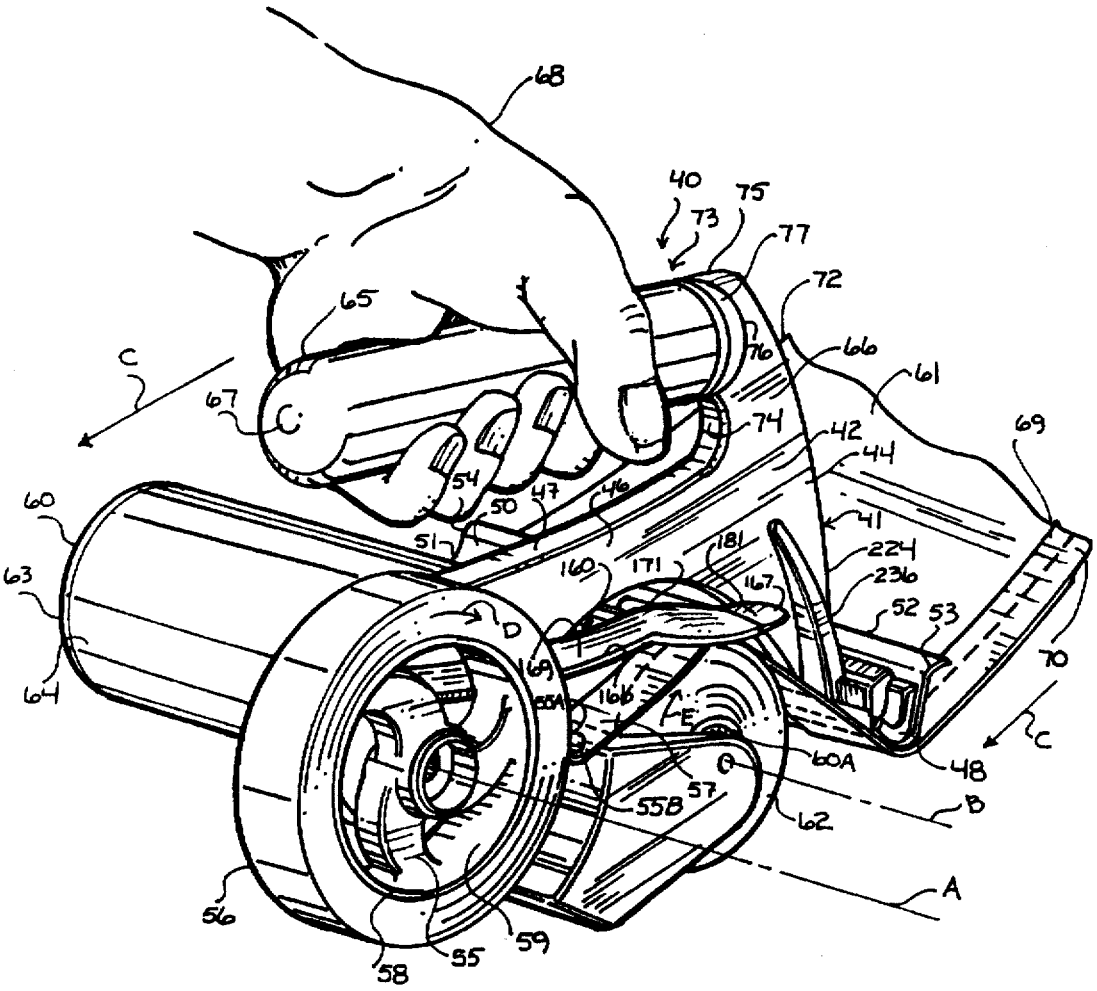
FIG. 1 is a perspective view of a prior art hand held masking machine incorporating improvements constructed in accordance with the teachings of the instant invention.

Turning now to the drawings in which like reference characters indicate corresponding elements throughout the several views, attention is first directed to FIG. 1 which shows a hand held masking machine generally designated by the reference character 40. The hand held masking machine 40 includes a frame 41 having substantially flat section 42 and primary offset section 43. For purposes of orientation, it is considered that frame 41 includes a forward portion 44 and a rearward portion 45, as further seen in FIG. 2. Additionally, substantially flat section 42 includes an outer surface 46 and an upper surface 47. At the forward portion 44, frame 41 is provided with a transverse elongate mounting bracket 48 having outer arcuate surface 49, as further seen in FIG. 4. Frame 41, including each of the foregoing named elements, is integrally formed of plastic in accordance with conventional injection molding techniques.

An elongate guide bar 50, stamped from relatively thin sheet metal, is detachably carried by mounting bracket 48 by means of a screw 50A received through aperture 50B and threadably retained thereon mounting bracket 48. Guide bare 50 includes an arcuate portion 51 and serrated cutting edge 52. Oriented perpendicularly to flat section 42, guide bar 50 further includes a fixed end 53 detachably secured to mounting bracket 48 and a free end 54. Outer arcuate surface 49 of bracket 48 is matingly received within arcuate portion 51.

Tape roll holder 55 is rotatably mounted upon a spindle, not immediately illustrated, integral with reward portion 45 of portion 45 of frame 41. Cooperating with the tape roll holder 55 is an elongate tape guide 55A extending outwardly from surface 46 and terminating with free end 55B. Holder 55 is retained upon the spindle by means of a washer (not herein specifically shown) and a screw (not herein specifically shown) which is threaded into the spindle. Holder 55 rotates about axis A which is generally parallel to guide bar 50, especially cutting edge 52. A roll 56 of coiled, pressure-sensitive nape 57 having core 58 with bore 59 is detachably carried by tape roll holder 55.

A roll 60 of coiled paper sheet 61 having first end 62, second end 63, core 60A and outer surface 64 is held by a paper roll holder rotatably carried by offset section 43. The paper roll holder, which will be described in further detail as the description ensues, is rotatable about axis B which is parallel to axis A.

Elongate handle 65, having an axis generally parallel to flat section 42 and generally perpendicular to axes A and B, extends from an upwardly extending portion 66 and terminates with a free end 67. Upwardly extending portion 66 is integral with said frame 41 proximate forward portion 44, and extends upwardly from frame 41. During operation, a human hand, such as designated by the reference character 68, holds handle 65 and moves the masking machine in the direction of arrowed line C. Accordingly, as sheet 61 is dispensed and remains stationary, roll 56 and paper roll 60 rotate in the direction of arrowed lines D and E, respectively. Paper roll 60 is offset relative tape roll 56 such that tape 57 overlaps end 62. Therefore, tape 57 includes a first continuous component 69 which is secured to the edge of paper sheet 61 and a second continuous component 70 which is available for continuous adhesion to the surface to be masked. Arcuate portion 51 of guide bar 50 functions as a shoe wiping along tape 57 to ensure adhesion to the surface. For purposes of orientation, sheet 61 is considered to have a fixed edge 71 and a free edge 72.

Improved Handle Means

Attention is now directed again to FIG. 1 and further to FIG. 2, FIG. 3, FIG. 4, and FIG. 10, which generally show the improvements of the instant invention including specifically, the improved handle means, generally designated by the reference character 73, for supporting the hand held masking machine 40 in a generally balanced orientation when lifted. As the description ensues, it will become apparent to those skilled in the art that the handle means 73 has further utility in connection with other apparatus for dispensing sheet material from a coiled roll thereof.

Figure 4:
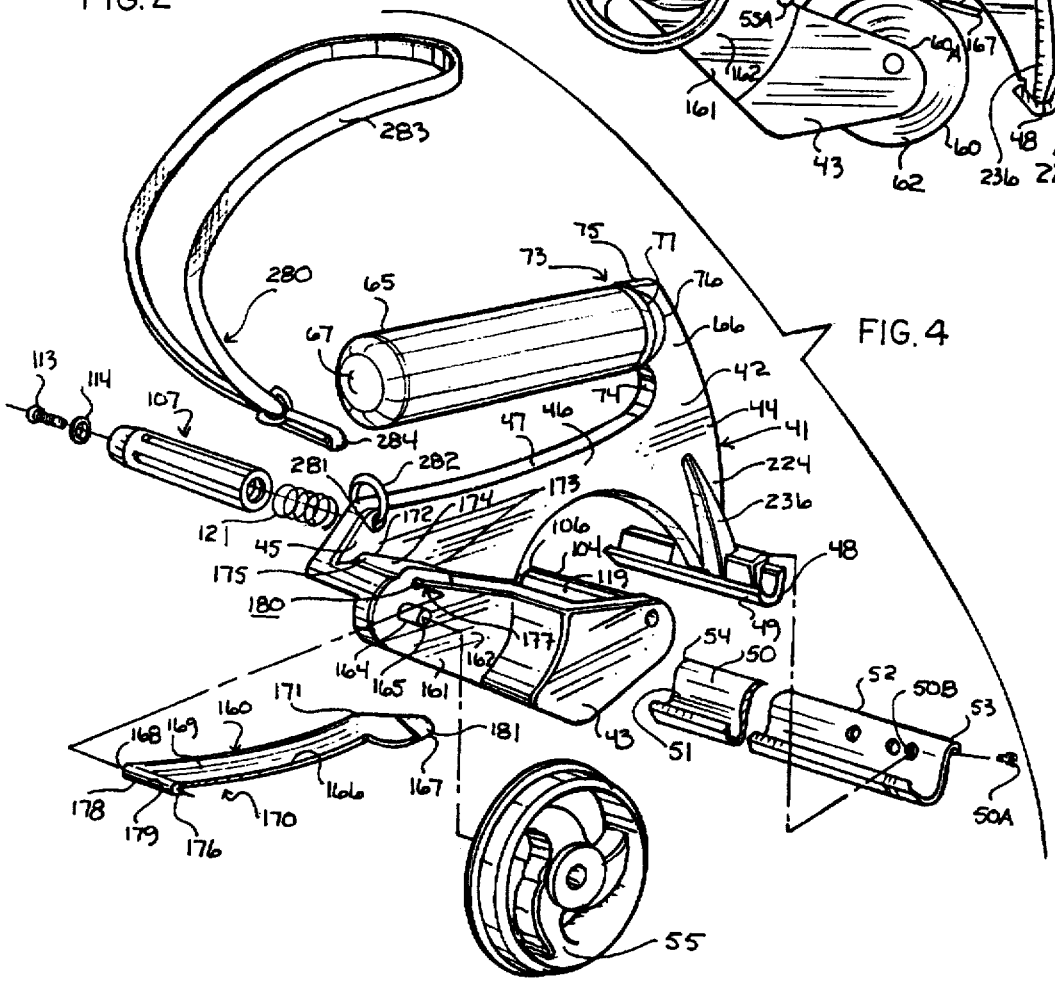
FIG. 4 is an enlarged exploded perspective view of the hand held masking machine of FIG. 1 and illustrating further improvements thereof.

Referring specifically to FIG. 4, it is seen that the improved handle means 73 first includes the upwardly extending portion 66 first illustrated in FIG. 1. Upwardly extending portion 66 includes a rearward surface 74 and an upper end 75. The elongate handle 65, first illustrated in FIG. 1, further includes an end 73 being fixedly attached to a terminal portion of rearward surface 74 proximate upper end 75, the elongate handle 65 extending in a generally rearwardly direction and terminating with the free end 67. Consistent with the preferred embodiment, the elongate handle 65 is generally cylindrical.

Referring to FIG. 10, the upwardly extending portion 66 is positioned along frame 41 at a balanced point thereof designated by axis F. As a result of such a configuration, when the elongate handle 65 of the hand held masking machine 40, having a tape roll 56 and paper roll 60 mounted thereon, is grasped by a human hand, such at the human hand 68 depicted in FIG. 1, and lifted, the hand held masking machine 40 is maintained in a generally balanced orientation during use. As herein specifically shown in FIG. 10, consistent with the preferred embodiment thereof, the upwardly extending portion 66 and the substantially flat section 42 are positioned in the same plane along axis F.

Figure 2:
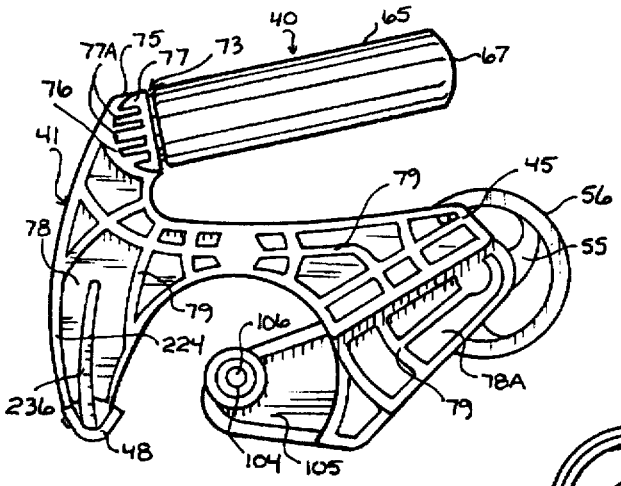
FIG. 2 is an inner side elevational view of the hand held masking machine of FIG. 1, the roll of paper being removed for purposes of illustration.
Figure 3:
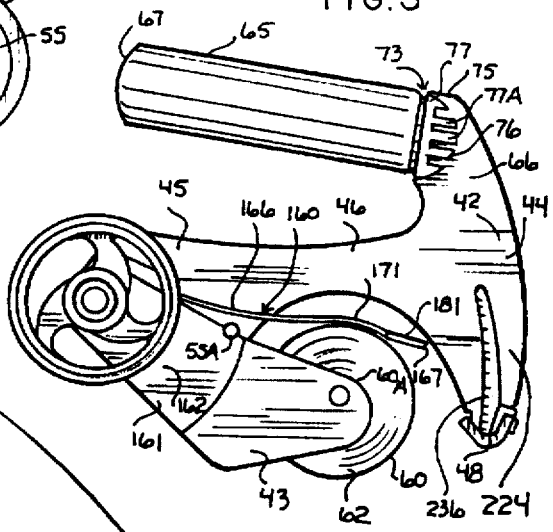
FIG. 3 is an outer side elevational the hand held masking machine of FIG. 1.

Referring to FIG. 2, FIG. 3, and FIG. 4, end 76 of handle 65 includes a mounting bracket 77 for being fixedly attached to the upwardly extending portion 66. As clearly illustrated in FIG. 2 and FIG. 3, mounting bracket 77 includes a plurality of support ribs 77A for added support and strength of handle 65.

Figure 8:
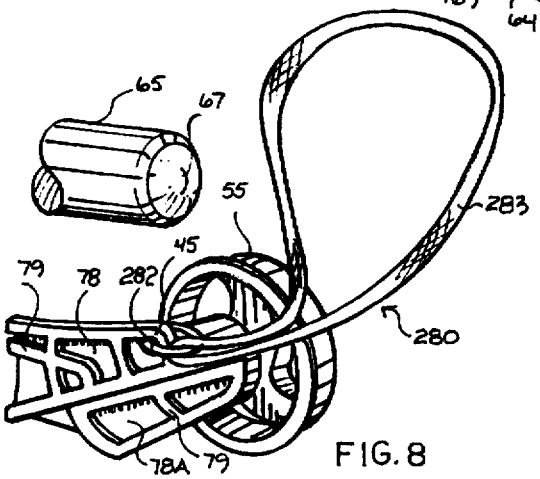
FIG. 8 is a fragmentary perspective view of a rear portion of the hand held masking machine of FIG. 1, and further illustrating a lanyard attached thereto.

With continuing reference to FIG. 2 and additional reference to FIG. 8 and to FIG. 16, which shows the hand held masking machine 40 as it would appear in use applying paper 61 and tape 57 to surface 33, although not necessarily associated with the improved handle means 73, frame 41 includes inner surfaces 78 and 78A. Integral with surfaces 78 and 78A are included a matrix of interconnected support members 79 for increasing the strength and resilience of frame 41.

Figure 5:
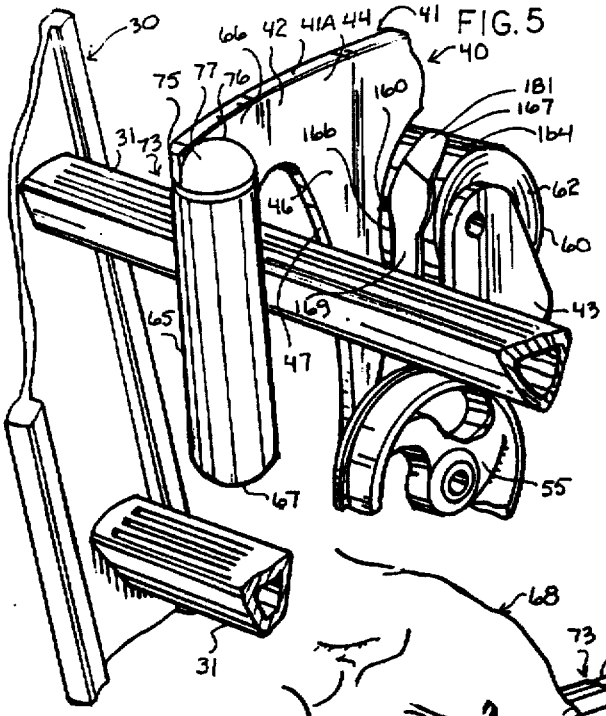
FIG. 5 is fragmentary perspective view of the hand held masking machine of FIG. 1, and illustrating said hand held masking machine as it might appear in cooperation with portions of a ladder.
Figure 6:
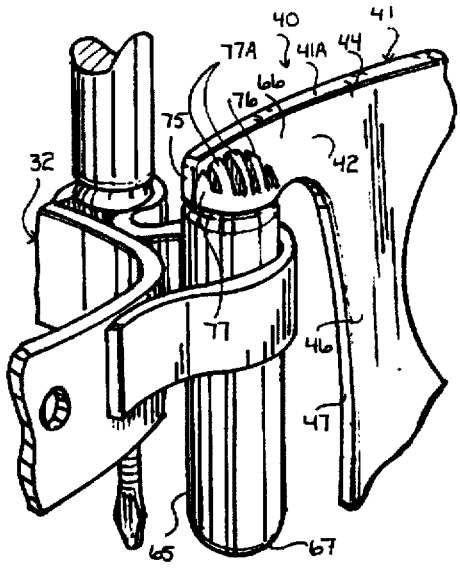
FIG. 6 is a fragmentary perspective view of the hand held masking machine very similar to the view of FIG. 5, illustrating the hand held masking machine as it might appear in cooperation with portions of a tool belt.
Figure 7:
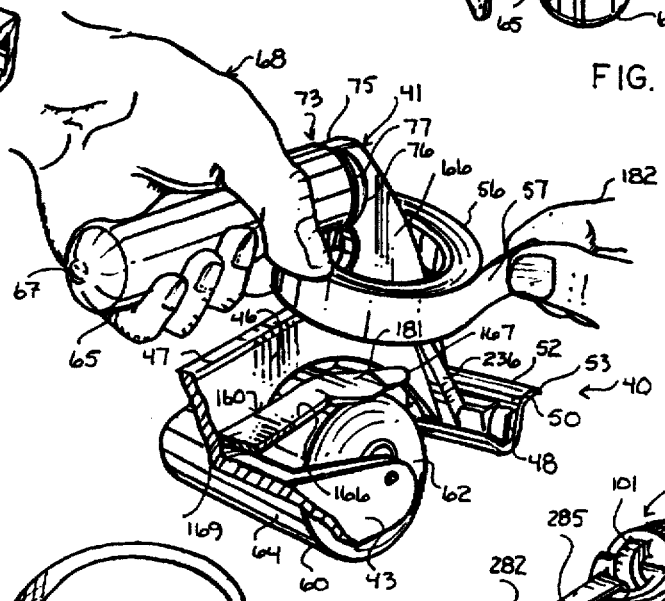
FIG. 7 is a fragmentary perspective view of the hand held masking machine of FIG. 1, illustrating said hand held masking machine as it might appear in use.

Referring next to FIG. 5, and as clearly illustrated therein, the improved handle means 73 may used in cooperation with a rung 31 of a ladder 30 for storage of holding purposes. Similar to FIG. 5, FIG. 6 clearly illustrates how the improved handle means may be employed with a tool belt 32. Also, with further reference to FIG. 7, a roll of tape, such as tape roll 56 first illustrated in FIG. 1, may also be used in cooperation with the improved handle means 73 and the frame 41.

Storing Means

Referring to FIG. 11, there is seen a storing means, generally designated by the reference character 80, for removably storing selected items. It is seen that the storing means 80 includes the handle 65 which was first illustrated in FIG. 1. The handle includes an outer sidewall 81 having an outer surface 82, with the improvements therein including an inner core 83 having an inner surface 84 defining a generally cylindrical longitudinally extending bore 85 extending therethrough said handle from an aperture 86 formed therein said free end 67, and terminating with end 76 which is closed.

Next provided, with respect to the preferred embodiment thereof as depicted in FIG. 11, is a closure means, generally designated by the reference character 87, for closing end 67. Consistent with the preferred embodiment, the closure means 87 includes a capping member 88 having an inner end 89 and an outer end 90. Next provided with respect to the closure means 87 includes an element 91 of an engagement pair proximate said capping member 88, and a complemental element 92 of said engagement pair proximate said handle 65, said element 91 and said complemental element 92 being detachably engageable therewith. Specifically, the element 91 of the engagement pair includes a pair of diametrically opposed tongs 93 extending therefrom the inner end 89 of the capping member 88 and terminating with free ends 94. Element 91 also includes a retention member 95 therebetween tongs 93 and includes an outer surface 96. The complemental element 92, illustrated in FIG. 11, includes a pair of diametrically opposed longitudinally extending recessed portions 97 proximate a terminal portion of end 67. Complemental element 92 also includes a pair of diametrically opposed apertures 98 proximate rearward ends 99 of recessed portions 97, the apertures 98 extending therethrough inner core 83.

Element 92 is sized to be received therein said bore 85, with the free ends 94 of tongs 93 having outwardly extending portions 100 sized to be matingly and detachably receivable therein the pair of diametrically opposed apertures 98, with the outer surface 96 of retention member 95 frictionally engageable with portions of the inner surface 84 of the inner core 83 proximate a terminal portion of free end 67 of handle 65.

As further illustrated in FIG. 11, the capping member 88 includes a an outwardly extending semi-annular ring 101 integrally attached to outer end 90. Also included is a D-ring 102 fixedly and movably retained thereby said ring 101.

Improved Paper Roll Holding Means

Referring to FIG. 12, FIG. 17 and FIG. 18, there is seen an improved paper roll holding means, generally designated by the reference character 103, which is a modification of conventional prior art roll holding means. In accordance with the masking machine described in connection with FIG. 1, FIG. 2 and FIG. 4, a spindle 104 extends therefrom inner surface 105 of offset section 43 of frame 41 in a direction toward the free end 54 of elongate guide bar 50, and terminating with a free end 106. Consistent with the preferred embodiment thereof, spindle 104 is generally tapered, generally tapering towards free end 106.

The improved paper roll holding means 103 includes a mandrel 107. Mandrel 107 includes an outer end member 108 comprising a generally cylindrical cone-shaped body 109 having an outer end 110, an inner end 111, and a blind bore 112 which is rotatably journaled upon spindle 104 proximate a terminal portion of free end 111. Screw 113, passing through washer 114 and outer end 110, threadably engages the free end 111 of spindle 104 for attachment of holder 107 to frame 41.

Mandrel 107 further includes a plurality of segments extending therefrom inner end 111 of cone-shaped body 109. Consistent with the preferred embodiment illustrated in FIG. 12, the segments include a plurality of longrens 115 which are annularly spaced-apart along inner end 111 and extend in an inwardly direction towards inner surface 105 of frame said longrens 115 terminating with free ends 116. Longrens 115 include outer surfaces 117, inner surfaces 118, and are normally outwardly biased, extending outwardly therefrom outer surface 119 of spindle 104, of which is easily seen in FIG. 17.

As can be seen in FIG. 18, the outer surfaces 117 of the longrens 115 include longitudinally extending contact portions 117A. The normal configuration of said longrens 115, herein being normally outwardly extending therefrom the outer surface 119 of spindle 104, provide for the contact portions 117A such that when paper roll 60 is inserted thereon the improved paper roll holding means 103 in the direction of arrowed line G, the longrens 115 compress in a direction towards the outer surface 119 of the spindle 104, the contact portions 117A of the longrens 115 imparting upon the core 60A of said paper roll 60 for retention of the paper roll thereon.

Next provided with respect to the improved paper roll holding means, illustrated in FIG. 12 and FIG. 17, includes a stopping means generally designated by the reference character 120, rotatably and slidably carried thereon a terminal portion of said spindle 104 proximate inner surface 105 of frame 41, for selectively inhibiting said longrens 115 of said mandrel from compressing beyond a selected collapsing point. Consistent with the preferred embodiment, the stopping means includes two elements, a compression spring 121 and a generally cylindrical member 122. The generally cylindrical member 122 includes an outer end 123, an inner end 124 facing the inner surface 105 of frame 41, an outer surface 125, and a bore 126 therethrough defined by inner surface 127, cylindrical member being slidably, frictionally and rotatably disposed thereupon spindle 104 proximate inner surface 105 of frame 41. The compression spring 121 is disposed between the inner surface 105 of frame 41 and inner end 124 and includes an outer end 128 which bears against inner end 124, and another end 129 for bearing against inner surface 105 of frame 41. Spring 121 functions as biasing means for normally urging generally cylindrical member 122 in a direction toward the outer end member 108 or mandrel 107.

Referring further to FIG. 12, FIG. 17 and FIG. 18, the inner surfaces 118 of the longrens 115 include recessed portions 130 proximate a terminal portion of the free ends 116 thereof, the recessed portions 130 terminating with end walls 131. The recessed portions 130 function to frictionally engage the outer surface 125 of generally cylindrical member 122 for selectively inhibiting said longrens 115 of said mandrel from compressing beyond a selected collapsing point. Portions of the outer end 123 of the generally cylindrical member 122 are additionally frictionally engageable with and bears against the end walls 131 when longrens 115 are compressed to a desired collapsing point for additionally urging the mandrel 107 in a direction away from frame 41.

Turning now to FIG. 13 and FIG. 14, illustrated is an alternate embodiment of an improved paper roll holding means including, as has herein specifically addressed in connection with FIG. 12, the spring 121, screw 113, washer 114, and mandrel 107. In connection with the alternate embodiment illustrated in FIG. 13, the mandrel 107 includes an elongate paper roll holder 132 which serves essentially the same function as the mandrel 107 described above in connection with FIG. 12. Specifically, the elongate paper roll holder includes an open inner end 133, an outer end 134, an outer surface 135, and a longitudinally extending blind bore 136 extending therethrough defined by inner surface 137. In lieu of the contact portions 117A described in connection with FIG. 12, integral with outer surface 135 of holder 132 exist outwardly extending contact members 138 having a pair of converging sidewalls 139 terminating at contacting surface 140 such that the contacting surfaces 140 partially embed within the core 60A for retention of the paper roll. FIG. 13 includes four contacting members 138. However, as can seen in FIG. 14, instead of having four contacting members 138, three may also be used.

Another alternate embodiment of the improved paper roll holding means, illustrated in FIG. 15, incorporates the same function and structure associated with the spring 121, screw 113, washer 114 and mandrel 107. In connection with the alternate embodiment shown in FIG. 15, the mandrel 107 includes a generally cylindrical inner member 141 having an inner end 142, an outer end 143, and a bore 144 extending therethrough defined by inner surface 145. Also included is a generally cylindrical outer member 146 also having an inner end 147, an outer end 148, and a bore 149 extending therethrough defined by inner surface 150. Also included with respect to the alternate embodiment shown in FIG. 15 are a pair of annularly spaced-apart longrens 151 having inner ends 152 integrally attached to the inner end 147 of outer member 146, and outer ends 153 integrally attached to the inner end 142 of inner member 141. The longrens 151 include lower surfaces 154 and contact portions 155, proximate upper surfaces 156 of said longrens, which are normally outwardly projecting in response to the spring 121 bearing against the outer end 143 of inner member 141, for normally engaging and thus retaining the core 60A of paper roll 60. Also included on the upper surfaces 156 of the longrens 151 are outwardly projecting contact elements which further embed within the core 60A for retention of the paper roll 60.

Improved Paper Tensioning Means

Figure 19:
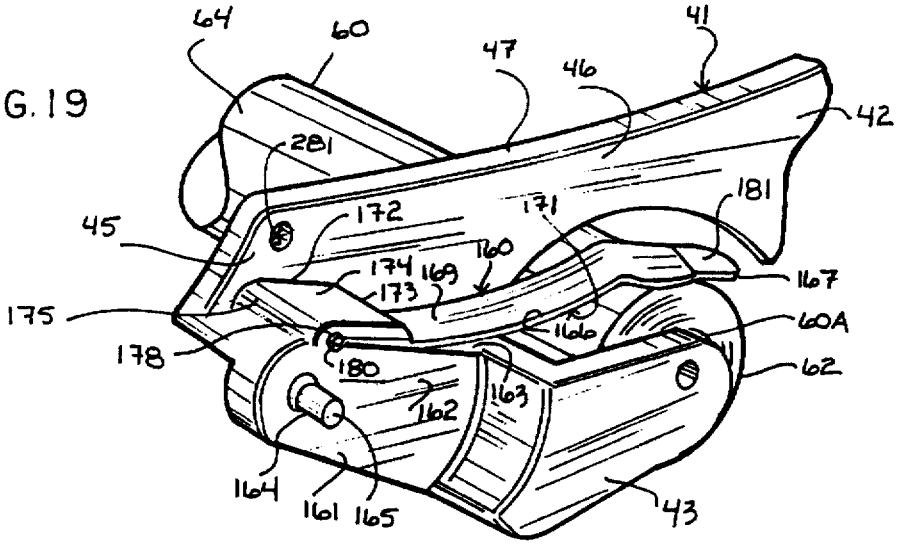
FIG. 19 is a fragmentary perspective view of the hand held masking machine of FIG. 1, and further illustrating an improved paper tensioning means.

Referring now to FIG. 19, and further to FIG. 1 and FIG. 4, there is seen an improved paper tension means, generally designated by the reference character 160, for applying tension to the outer surface of the paper roll, checking uncoiling of the paper sheet, and having a lifting portion integral with the paper tensioning means for easily releasing the tension on the paper roll.

For purposes of orientation, frame 41 includes a secondary offset portion 161 proximate rearward portion 45, which is also offset relative to primary offset portion 43. Secondary offset portion includes an outer surface 162 and an upper surface 163. Also included in cooperation with the secondary offset portion 161 is a spindle 164 extending outwardly from outer surface 162 and terminating with a free end 165. As can be seen in FIG. 4, the tape roll holder 55 is rotatably carried thereon spindle 164.

With respect to the improved paper tensioning means 160, first provided is a flexible elongate tensioning member 166 having a forward end 167, a rearward end 168, an upper surface 169, a lower surface 170, and a normally upwardly extending portion 171. Next provided is a connecting means for fixedly carrying the tensioning member 166 to frame 41. Consistent with the preferred embodiment, the connecting means comprises a forwardly extending bracket 172 having a forward end 173, an upper surface 174, a lower surface (not herein specifically shown), and a generally downwardly extending arcuate rearward end 175 integral with upper surface 163 proximate the rearward portion 45 of frame 41, such that the lower surface of the forwardly extending bracket is facing upper surface 163.

With continuing reference to FIG. 4, the rearward end 168 of the tensioning member 166 comprises an element 176 of an engagement pair, and portions therein bracket 172 comprise a complemental element 177 of the engagement pair, for fixedly engaging tensioning member 166 to the bracket 172. The element 176 of the engagement pair proximate rearward end 168 of tensioning member 166 comprises an arcuate portion 178 having an arcuate surface 179. The complimental element 177 of the engagement pair comprises a semi-annular laterally extending bore 180 formed proximate the lower surface of bracket 172 at the point where the rearward end 175 and upper surface 163 converge. The element 176 is fixedly engageable with complimental element 177. In other words, arcuate portion 178 is fixedly engageable therein bore 180, such that the lower surface of bracket 172 bears against the upper surface 169 of the tensioning member 166, and the upper surface 163 of the secondary offset portion bears against the lower surface 170 of the tensioning member 166, such that the tensioning member 166 extends forwardly towards forward portion 44 in a generally downwardly direction. As can be seen in FIG. 19, a paper roll 60 is being retained thereon masking machine 40, with portions of the lower surface 170 of the tensioning member 166 proximate a terminal portion of the forward end 167 bearing against the outer surface 64 of the paper roll 60.

During operation, portions of the lower surface 170 of the tensioning member 166 proximate a terminal portion of the forward end 167 function as a bearing element, and in response to tension applied across tensioning member 166 in the direction shown by arrowed line H in FIG. 19, maintains tension upon the outer surface 64 of roll 60 ensuring even movement of roll 60 during the dispensing of paper sheet 61 and, as is apparent from FIG. 1, urges component 69 of tape 57 onto the edge of paper sheet 61 so as to ensure adhesion of the tape thereto.

Also included with respect to the improved paper tensioning means 160 is a lifting portion 181 proximate a terminal portion of forward end 167 of tensioning member 166. The lifting portion 181, which extends forwardly beyond paper roll 60, comprises a means for lifting the tensioning member upwardly and away from the outer surface 64 of roll 60 for releasing the tension applied thereto.

Figure 22:
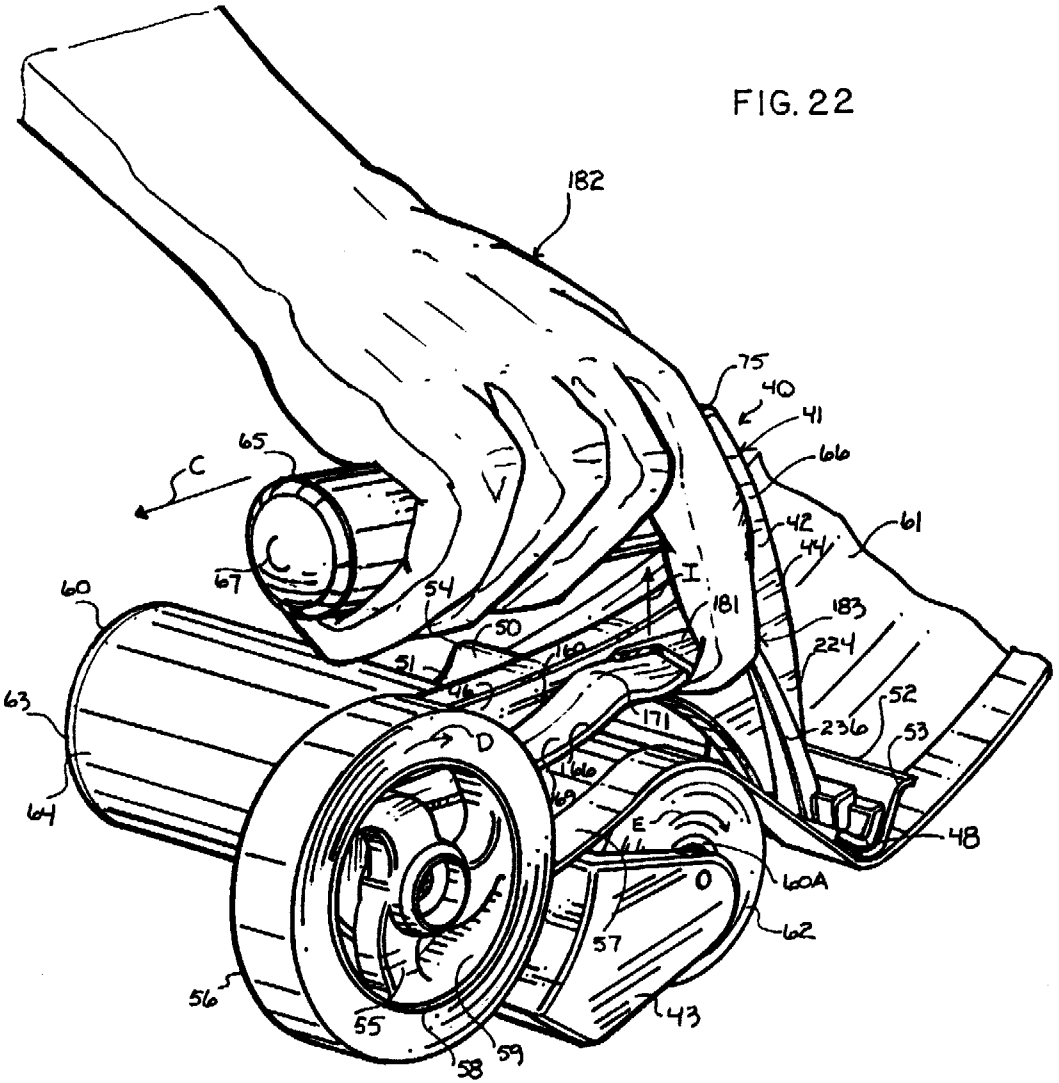
FIG. 22 is an enlarged perspective view of the hand held masking machine of FIG. 1, and further illustrating said hand held masking machine being held by a human hand, with the index finger thereof engaging portions of the embodiment of the improved paper tensioning means illustrated in FIG. 19.
Figure 23:
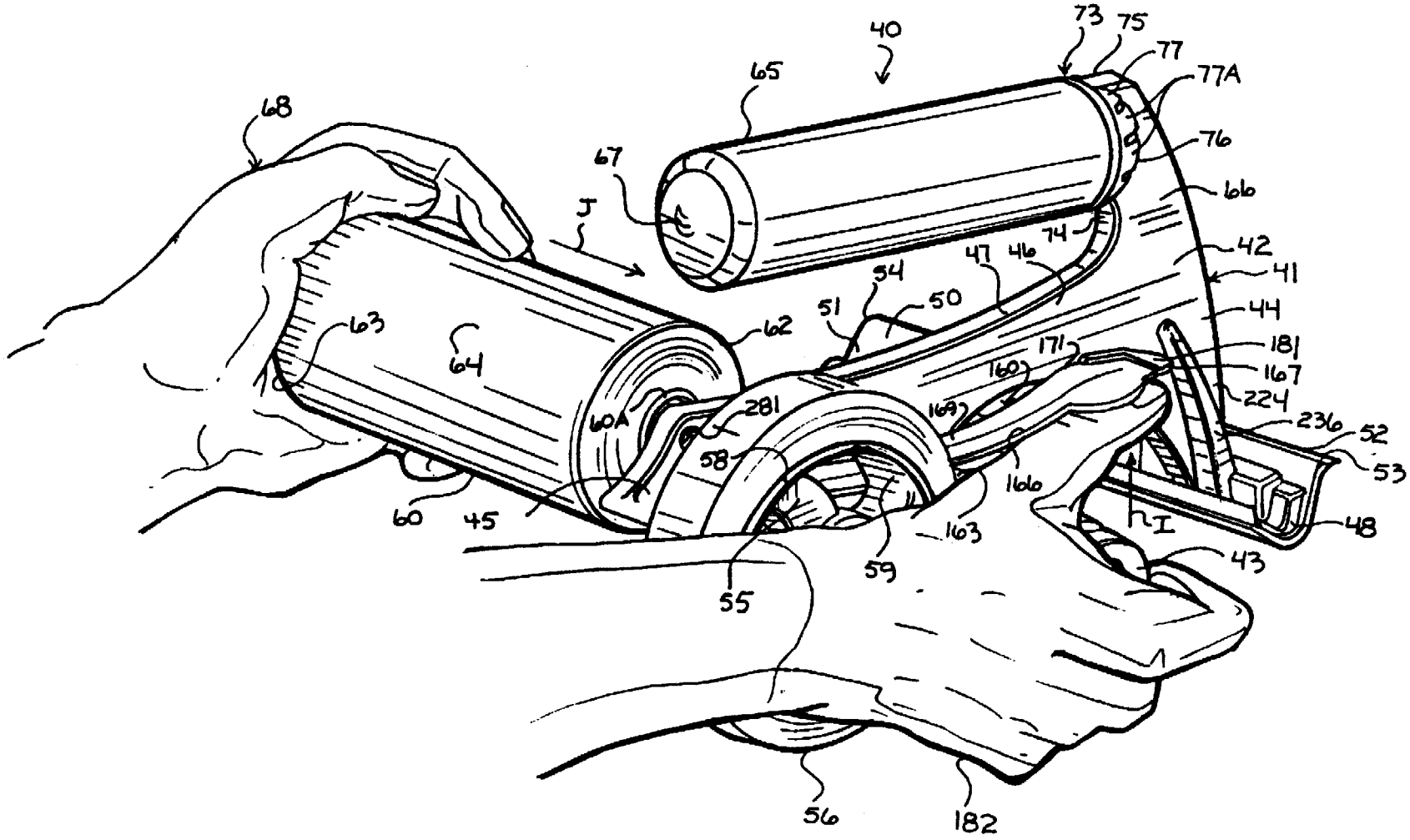
FIG. 23 is an enlarged perspective view of the hand held masking machine of FIG. 1, and further illustrating a roll of paper being inserted thereon in cooperation with the improved paper tensioning means of FIG. 19.

Specifically, turning now to FIG. 22, illustrated is the masking machine 40 as it would appear in use with a human hand, such as designated by the reference character 182, holding handle 65 with a finger, such as designated by the reference character 183, engaging lifting portion 181 and lifting the tensioning member 166 away from the outer surface 64 of roll 60 in the direction of arrowed line I. As a result of the proximation of the lifting portion 181 in relation to handle 65, the paper tensioning means 160 may be released from the outer surface 64 of roll 60 during use thereof. Additionally, as can be seen in FIG. 23, hand 182 may be employed to lift the lifting portion 181 of the tensioning member 166, and hand 68 may be used conjunctively to insert a roll of paper upon the hand held masking machine 40, the roll 60 of paper 61 being inserted in the direction indicated by arrowed line J.

Figure 20:
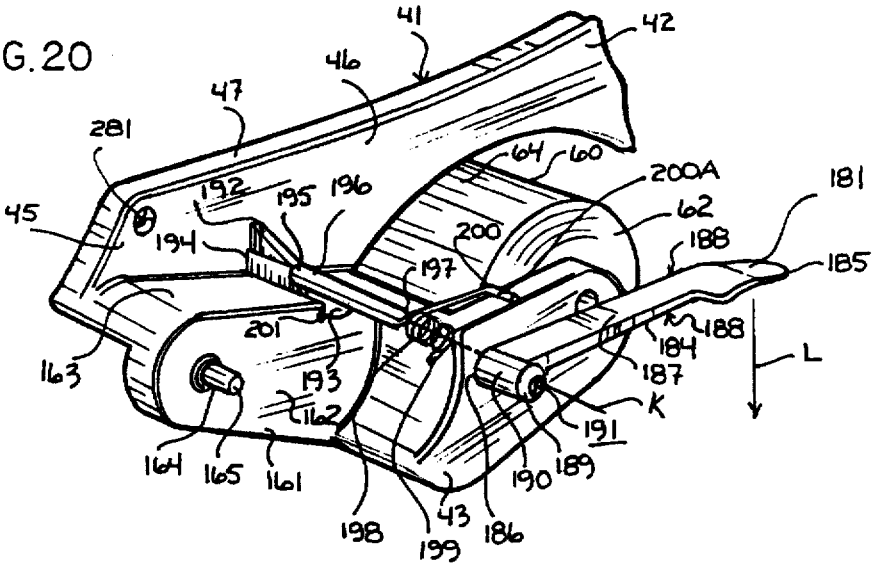
FIG. 20 is a fragmentary perspective view of the hand held masking machine very similar to that seen in FIG. 19 and further illustrating an exploded perspective view of an alternate embodiment of the improved paper tensioning means.

An alternate embodiment of the improved paper tensioning means 160 is illustrated in FIG. 20, which is seen a substantially rigid generally elongate member 184 having a forward end 185, a rearward end 186, an upper surface 187 and a lower surface 188. Rearward end 186 includes a generally cylindrical member 189 having an outer surface 190 and a laterally extending bore 191 extending therethrough.

Next provided is bracket portion 192 disposed within a terminal portion of a laterally extending recessed portion 193 formed thereon the upper surface 163 of the secondary offset portion 161, the bracket portion 192 having an end 194 integrally attached to the outer surface 46 of substantially flat section 42, and a second end 195. Also included is a substantially rigid generally cylindrical elongate member 196 having an end integrally attached to second end 195 and terminating with a free end 197. Illustrated in FIG. 20, member 196 extends outwardly therefrom frame 41 along axis K. Rearward end 186 pivotally resides thereon elongate member 196, the elongate member 196 being receivable by the bore 191 of generally cylindrical member 189. The pivotal axis K of member 184 about elongate member 196 is generally parallel to previously described axes A and B in accordance with FIG. 1.

A conventional torsion spring 198 having ends 199 and 200 resides thereon elongate member 196. end 199 resides within notch 201. End 200, having a laterally extending contact member 200A, resides on the upper surface 187 of elongate member 184. Accordingly, torsion spring 198 functions as a biasing means for urging forward end 185 in a direction towards paper roll 60 as indicated by the arrowed line L. Similar to the improved paper tensioning means described in connection with FIG. 19, the elongate member 184 functions as a bearing element, and in response to torsion spring 198, maintains tension upon the outer surface 64 of roll 60 ensuring even movement of roll 60 during the dispensing of paper sheet 61. Consistent with the improvements herein, forward end 185 includes the lifting portion 181 described in connection with FIG. 19.

Figure 21:
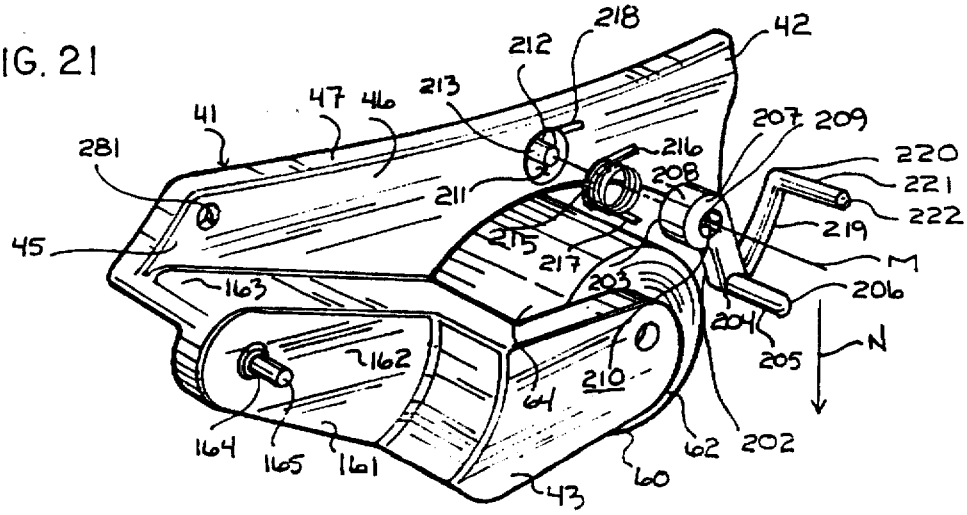
FIG. 21 is a fragmentary perspective view of the hand held masking machine very similar to that seen in FIG. 20, and further illustrating yet another exploded perspective view of an alternate embodiment of the improved paper tensioning means.

Yet still another embodiment of the improved paper tensioning means is illustrated in FIG. 21, which is seen an arm 202 having a fixed end 203, and a free end 204 having a laterally extending member 205 extending outwardly therefrom away from frame 41, and terminating with an outer end 206. Fixed end includes a generally cylindrical member 207 having an outer surface 208, inner surface 209, and a laterally extending bore 210. Next provided is a blind bore 211 formed on the outer surface 46 of substantially flat section 42, having a laterally extending generally cylindrical member 212 protruding therefrom along axis M, having an outer surface 213 and a free end 214. Fixed end 203 resides therein bore 211, and pivotally thereon member 205, member 205 being receivable by bore 210. The pivotal axis M of arm 202 about member 212 is generally parallel to previously described axes A and B described in accordance with FIG. 1.

A torsion spring 215, similar to torsion spring 198, having ends 216 and 217, resides within bore 211. End 216 resides within notch 218. End 217 resides within a notch (not herein specifically shown) proximate fixed end 203 of arm 202.

Accordingly, torsion spring 215 functions as a biasing means for urging free end 204 of arm 202, having the laterally extending member 205, in a direction toward roll 60 as indicated by arrowed line N in FIG. 21. Similar to the improved paper tensioning means described in connection with FIG. 19 and FIG. 20, arm 202 having the laterally extending member 205 functions as a bearing element, and in response to torsion spring 215, maintains tension upon the outer surface 64 of roll 60 ensuring even movement of roll 60 during the dispensing of paper sheet 61. Consistent with the improvements herein, as herein specifically described in accordance with the embodiments illustrated in FIG. 19 and FIG. 20, free end 204 includes an integrally attached upwardly extending member 219 terminating with a free end 220. Free end 220 includes an integrally attached laterally extending elongate member 221 having a free end 222. Member 219, free end 220, member 221 and free end 222 all cooperate together to form a lifting portion as herein specifically described as pertains to lifting portion 181 shown in FIG. 19.

Improved Cutting Means

Figure 24:
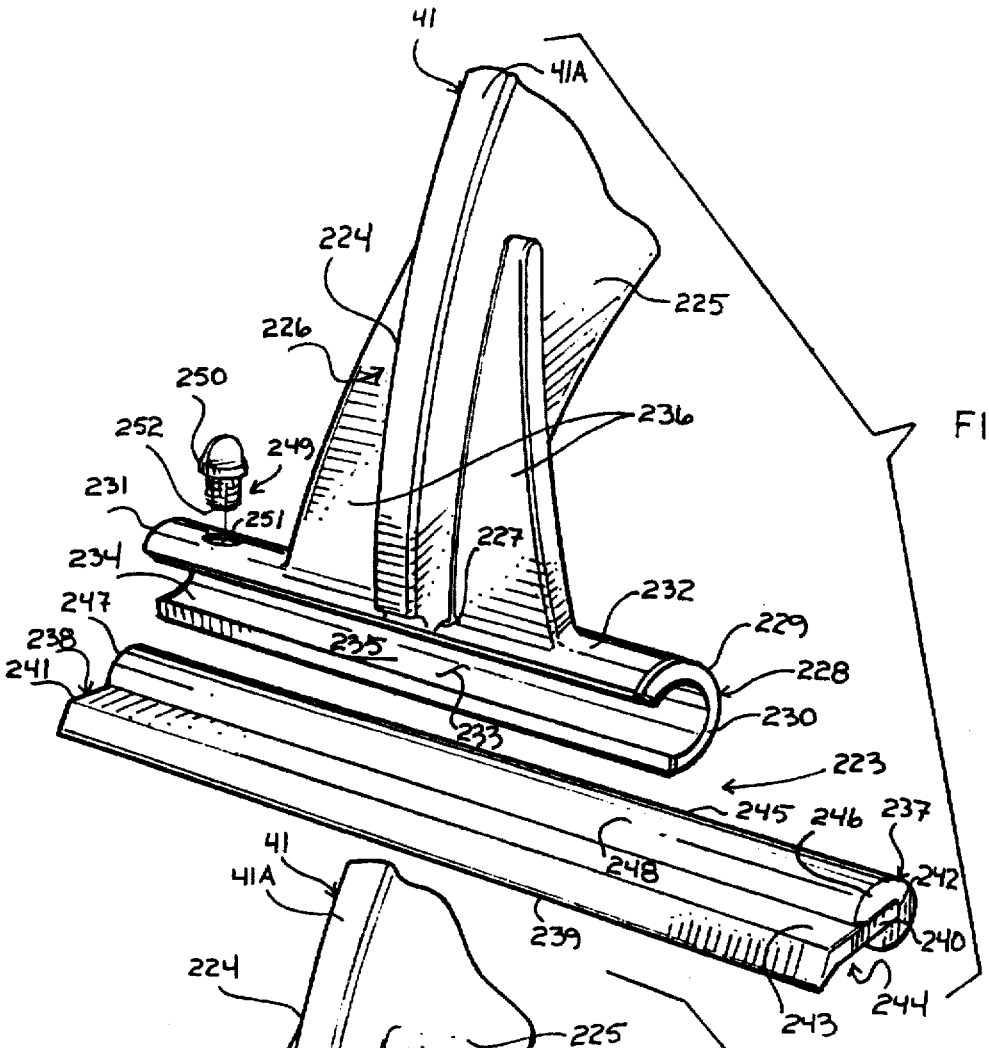
FIG. 24 is an enlarged fragmentary perspective view of portions of the hand held masking machine of FIG. 1, and further illustrating further improvements therein constructed in accordance with the teachings of the instant invention directed to an improved cutting means.

Turning now to FIG. 24, there is seen improved paper cutting means, generally designated by the reference character 223, which is an improvement of the prior art paper cutting means. In further accordance with FIG. 1, frame 41 includes a forward surface 41A, a downwardly extending portion 224 having side-surfaces 225 and 226. Downwardly extending portion 224 includes a forward end 227 integrally attached to a female engagement element, generally designated by the reference character 228, of an engagement pair. The female engagement element 228 shown in FIG. 24, includes an elongate generally C-Shaped bracket 229 having a first end 230, a second end 231, an outer surface 232, a longitudinally extending opening 233, and an inner surface 234 defining a semi-cylindrical bore 235. The outer surface 232 of bracket 229 is integrally attached to forward end 227 such that the longitudinally extending opening 233 is forwardly directed. Also included are a pair of opposed gussets 236 integrally attached to side-surfaces 225 and 226, and the outer surface 232 of bracket 229. As it will be readily appreciated by those skilled in the art, gussets 236 are well known such that specific elements therewith not herein specifically described or addressed will be readily apparent by those skilled in the art.

Next provided with respect to the improved paper cutting means 233 is a male engagement element 237 of the engagement pair, said male element 237 being carried by an elongate blade portion 238 having a forward cutting end 239, first end 240, second end 241, rearward end 242, upper surface 243, and lower surface 244. The male element 237 shown in FIG. 24 comprises a longitudinally extending semi-cylindrical elongate member 245 having a first end 246, a second end 247, and an outer surface 248. Elongate member 245 resides thereon the length of rearward end 242 and terminal portions of upper surface 243 and lower surface 244, member 245 sized to be matingly engageable therein semi-cylindrical bore 235 for securing blade portion 238 to frame 41 of hand held masking machine 40.

Also included with respect to the preferred embodiment of the improved paper cutting means shown in FIG. 24 is a retention means, generally designated by the reference character 249, for fixedly retaining the male engagement element 237 to the female engagement element 228. As herein specifically shown, the retention means includes a screw 250 threadably receivable therein aperture 251 extending therethrough bracket 229. As such will be readily appreciated by those skilled in the art, screw 250 further includes an end 252 such that when screw 250 is tightened, end 252 will bear against the outer surface 248 for fixedly retaining the male engagement element 237 to the female engagement element 228.

Figure 25:
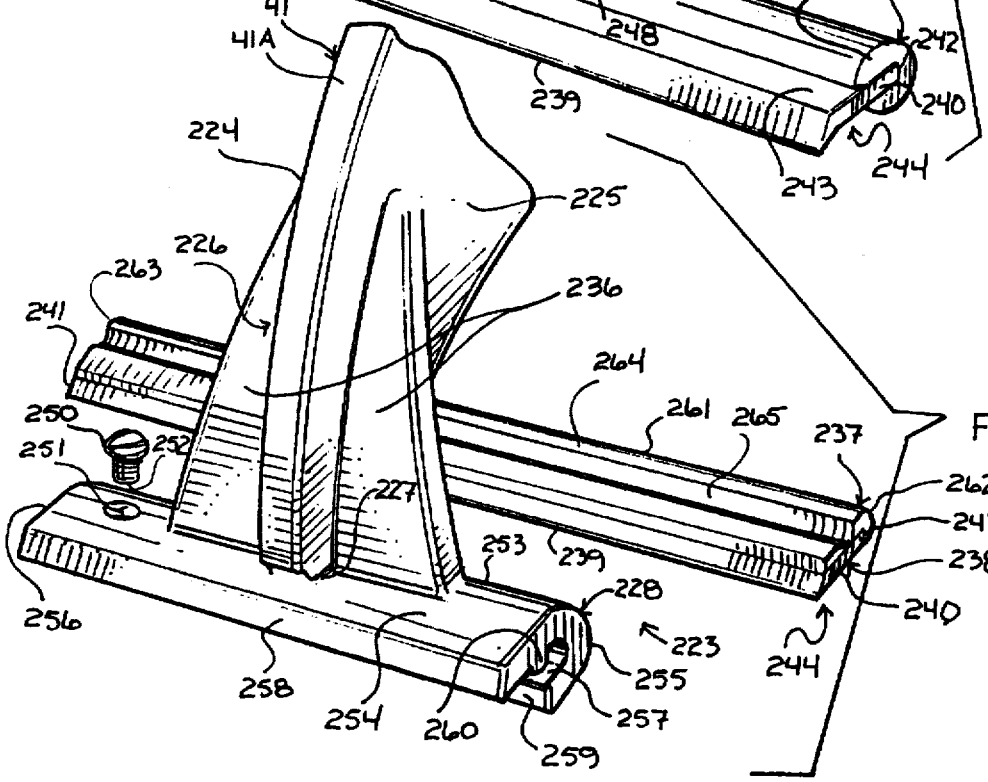
FIG. 25 is an enlarged fragmentary perspective view of portions of the hand held masking machine very similar to the view of FIG. 24, and illustrating an alternate embodiment of the improved cutting means.
Figure 26:
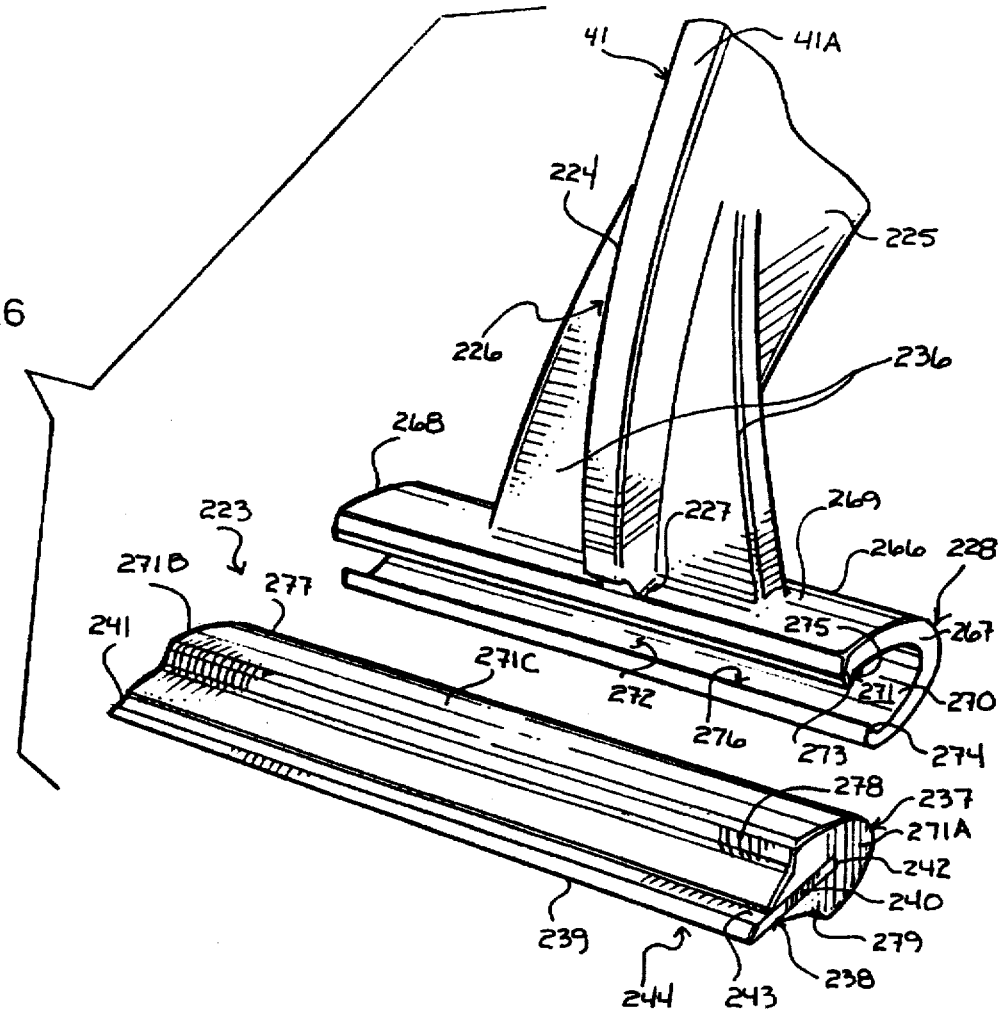
FIG. 26 is an fragmentary perspective view of portions of the hand held masking machine very similar to that seen in FIG. 24, and further illustrating yet another alternate embodiment of the improved cutting means.

Consistent with the teachings herein in accordance with FIG. 24, a further embodiment of the improved paper cutting means 223 is illustrated in FIG. 25, wherein the female engagement element 228 includes an elongate generally J-shaped bracket 253 in lieu of the generally C-shaped bracket 229 shown in FIG. 24. The generally J-shaped bracket 253 includes outer surface 254, first end 255, second end 256, an inner surface 257, an upper longitudinal edge 258 and a lower longitudinal edge 259. As clearly illustrated in FIG. 25, edge 258 extends forwardly of edge 259. Bracket 253 also includes a longitudinally extending locating member 260.

Consistent with the teachings herein described with respect to FIG. 24, the male element includes the blade portion 238 having an elongate contact portion 261 having form-fitted surfaces (not herein specifically shown) for being closely disposed thereupon upper surface 243 and thereal-ong rearward end 242. Contact portion 261 further includes a first end 262, a second end 263, and an upper surface 264 having a longitudinally extending recess 265 for being matingly received by locating member 260. The locating member 260 and recess 265 cooperate together to form a stabilizing means for preventing relative motion between the male and female elements. Also included with respect to the alternate embodiment illustrated in FIG. 25, is the retention means 249 herein described in accordance with FIG. 24.

Yet still another embodiment of the improved paper cutting means 223, and being consistent with the teachings herein, includes said female engagement element 228 comprising a generally V-shaped bracket 266 having a first end 267, a second end 268, an outer surface 269, an inner surface 270 defining a generally V-shaped bore 271, and a forwardly directed longitudinally extending opening 272 defined by a pair of opposed inwardly directed lips, 273 and 274 respectively. Lips 273 and 274 also have inner contact surfaces, 275 and 276 respectively. The male engagement element includes an elongate generally V-shaped member 277 carried by the blade portion 238, closely receivable therein bore 271, and having a first end 271A, a second end 271B, an outer surface 271C, and upper and lower longitudinal edges, 278 and 279. Edges 278 and 279 bear against contact surfaces 275 and 276 respectively and accordingly function as stabilizing means for inhibiting relative motion between the male and female engagement elements.

Holding Means

Figure 9:
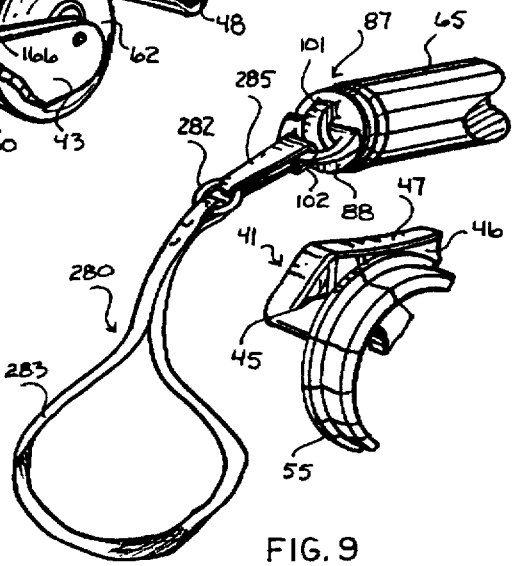
FIG. 9 is a fragmentary perspective view of a handle portion of the instant invention of FIG. 1, and further illustrating a lanyard attached thereto.

In cooperation with the hand held masking machine as thus described and the embodiments described herein constituting improvements to the prior art, FIG. 4, FIG. 8 and FIG. 9 illustrate a three alternate embodiments of a holding means 280 for holding the hand held masking machine during periods of non-use. Specifically, FIG. 4 clearly shows an aperture 281 therethrough frame 41 proximate rearward end 45, and having a ring 282 carried therein. A lanyard 283 is also seen attached to a clip 284 which may be clipped onto ring 282 for supporting the hand held masking machine when not in use. In FIG. 8, lanyard 283 is shown attached directly to ring 282. Additionally, FIG. 9 shows lanyard 283 attached to ring 282 of which is attached to a snap clip 285 which is then attached to D-ring 102. In light of FIG. 10, which illustrates a balanced point of frame thereof designated by axis F, the holding means 280 may be attached to the handle 65 or to a point along frame 41 proximate balanced point F such that the holding means 280 holds the hand held masking machine in a generally balanced orientation during periods of non-use.

Various modifications and changes to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described and disclosed the present invention in such clear and concise terms as to enable those skilled in the art to understand and practice the same, the invention claimed is:

1. In a hand held masking machine for dispensing paper having tape overlapping an edge thereof, said hand held masking machine including:

a frame;

a roll holder rotatably attached to said frame and terminating with a free end and having an outer surface;

said roll including a core having a bore with a generally cylindrical surface;

improvements therein comprising:

a mandrel having normally extending biased segments, said segments being compressed in opposition to biasing means, said bore being receivable over said outer surface in a direction from said free end.

2. The hand held masking machine of claim 1;

wherein said mandrel includes a generally cylindrical outer portion having an inner end; and wherein said segments include a plurality of annularly spaced-apart inwardly extending normally outwardly biased longrens having ends carried thereby said inner end, said longrens having outer surfaces and inner surfaces.

3. The hand held masking machine of claim 2, wherein the outer surfaces of said longrens include longitudinally extending contact portions.

4. The hand held masking machine of claim 3, wherein said biasing means includes:

a stopping means, rotatably and slidably carried thereon said roll holder, for selectively inhibiting said longrens of said mandrel from collapsing beyond a selected collapsing point; and a compression spring for normally biasing said stopping means in a direction away from said frame.

5. The hand held masking machine of claim 4, wherein:

said stopping means includes an outer surface receivable thereagainst recessed portions formed therein terminal portions of the inner surfaces of said longrens.

6. The hand held masking machine of claim 1, wherein said mandrel includes:

outer and inner end portions; and a plurality of annularly spaced-apart longrens having normally outwardly projecting portions intermediate thereat, said longrens having inner ends carried by said inner end portion, and outer ends carried by said outer end portion, said normally outwardly projecting portions being flexibly movable in directions toward and away from the outer surface of said roll holder.

7. The hand held masking machine of claim 6 wherein said biasing means includes a compression spring.

8. In a hand held masking machine for dispensing paper having tape overlapping an edge thereof, said hand held masking machine including:

a frame having a handle carried thereby for being held by a human hand; and a paper tensioning member having an end for applying tension to a roll of paper and for checking uncoiling of said paper thereon;

improvements therein comprising:

a lifting portion integral with said tensioning member for releasing said tension, said lifting portion accessible by a finger of the hand while the grip is being maintained.

9. In a hand held masking machine for dispensing paper having tape overlapping an edge thereof, said hand held masking machine including:

a frame; and a cutting means for severing the paper and tape therefrom said hand held masking machine;

improvements therein for an improved paper cutting means, comprising:

a male/female engagement pair for securing a blade portion to said frame, said male engagement element carried by said blade portion and said female engagement element carried by said frame.

10. The hand held masking machine of claim 9, wherein said female engagement element includes an elongate generally C-shaped bracket.

11. The hand held masking machine of claim 10, wherein said male engagement element includes a semi-cylindrical elongate member residing thereon said blade portion and being detachably engageable with said C-shaped bracket.

12. The hand held masking machine of claim 9, wherein said female engagement element includes an elongate generally J-shaped bracket.

13. The hand held masking machine of claim 12, wherein said J-shaped bracket includes:

an elongate locating member; and an upper longitudinal edge and a lower longitudinal edge, said upper longitudinal edge extending forwardly of said lower longitudinal edge.

14. The hand held masking machine of claim 13, wherein said male engagement element includes a longitudinally extending contact portion residing thereon said blade portion, wherein said contact portion includes:

an upper surface; and a longitudinally extending recess receivable thereby said locating member.

15. The hand held masking machine of claim 9 wherein said female engagement element includes an elongate generally V-shaped bracket.

16. The hand held masking machine of claim 15, wherein said V-shaped bracket includes a pair of opposed inwardly extending lips having inner contacting surfaces.

17. The hand held masking machine of claim 16, wherein said male engagement element includes a generally V-shaped elongate member residing thereon said blade portion and having an upper longitudinal edge and a lower longitudinal edge, said V-shaped member being detachably engageable therewith said V-shaped bracket, said inner contacting surfaces engageable thereagainst said upper and lower longitudinal edges.

* * * * *